United States Patent [19]

Guiraud

[11] 4,196,606

[45] Apr. 8, 1980

[54] BRAMAH LOCKS

[75] Inventor: Francois Guiraud, Chambourcy, France

[73] Assignee: Fichet-Bauche, Velizy, France

[21] Appl. No.: 896,134

[22] Filed: Apr. 13, 1978

[30] Foreign Application Priority Data

Apr. 15, 1977 [FR] France ..... 77 11506

[51] Int. Cl.[2] ..... E05B 29/02

[52] U.S. Cl. ..... 70/363; 70/365

[58] Field of Search ..... 70/365, 366, 363, 357, 70/362

[56] References Cited

U.S. PATENT DOCUMENTS 3,404,548 10/1968 Keefer ..... 70/366

FOREIGN PATENT DOCUMENTS 2420272 12/1974 Fed. Rep. of Germany ..... 70/365
2640947 3/1978 Fed. Rep. of Germany ..... 70/365
659113 1/1929 France ..... 70/365
997552 9/1951 France ..... 70/365

*Primary Examiner*—Robert L. Wolfe

[57] ABSTRACT

There is disclosed a Bramah lock which comprises locking lever bars mounted for longitudinal displacement and rotation, said bars having each two cuttings, thereby providing the lock with a double safety device as long as the bars are not actuated by the key to their unlocked position. The lock is therefore a double security lock offering an increased resistance to unauthorized attempts to pick it and a larger number of combinations.

14 Claims, 23 Drawing Figures

162
161
164
163
166
165
167
178
160

162
161
163
16
16
165
178

302
301
325
303
314

302
301
303
23
23

169
172
171
168₁
168₇

306
308
305
309
304
307

BRAMAH LOCKS

The present invention relates to a Bramah lock.

Bramah locks are known in which the introduction of the key causes a longitudinal displacement of cut out locking bars in such manner that when the key is totally introduced, the bars cuttings set the lock in an unlocked state.

Bramah locks are also known which comprise levers or cranks pivotally mounted about transverse axes and in which the key is formed with tumblers which, by cooperating with the noses of the levers, pivot the latter into an unlocked state when the key is completely introduced.

The object of the invention is a Bramah lock comprising locking lever bars which are mounted for longitudinal displacement and rotation and have each two cuttings, thereby providing the lock with a double safety device as long as they are not actuated by the key to their unlocked position.

The lock according to the invention is therefore a double security lock.

It offers an increased resistance to unauthorized attempts to pick the lock.

It provides a larger number of combinations.

Its manufacture is simple.

The following description is given by way of example, reference being made to the accompanying drawings wherein.

Figure 1:
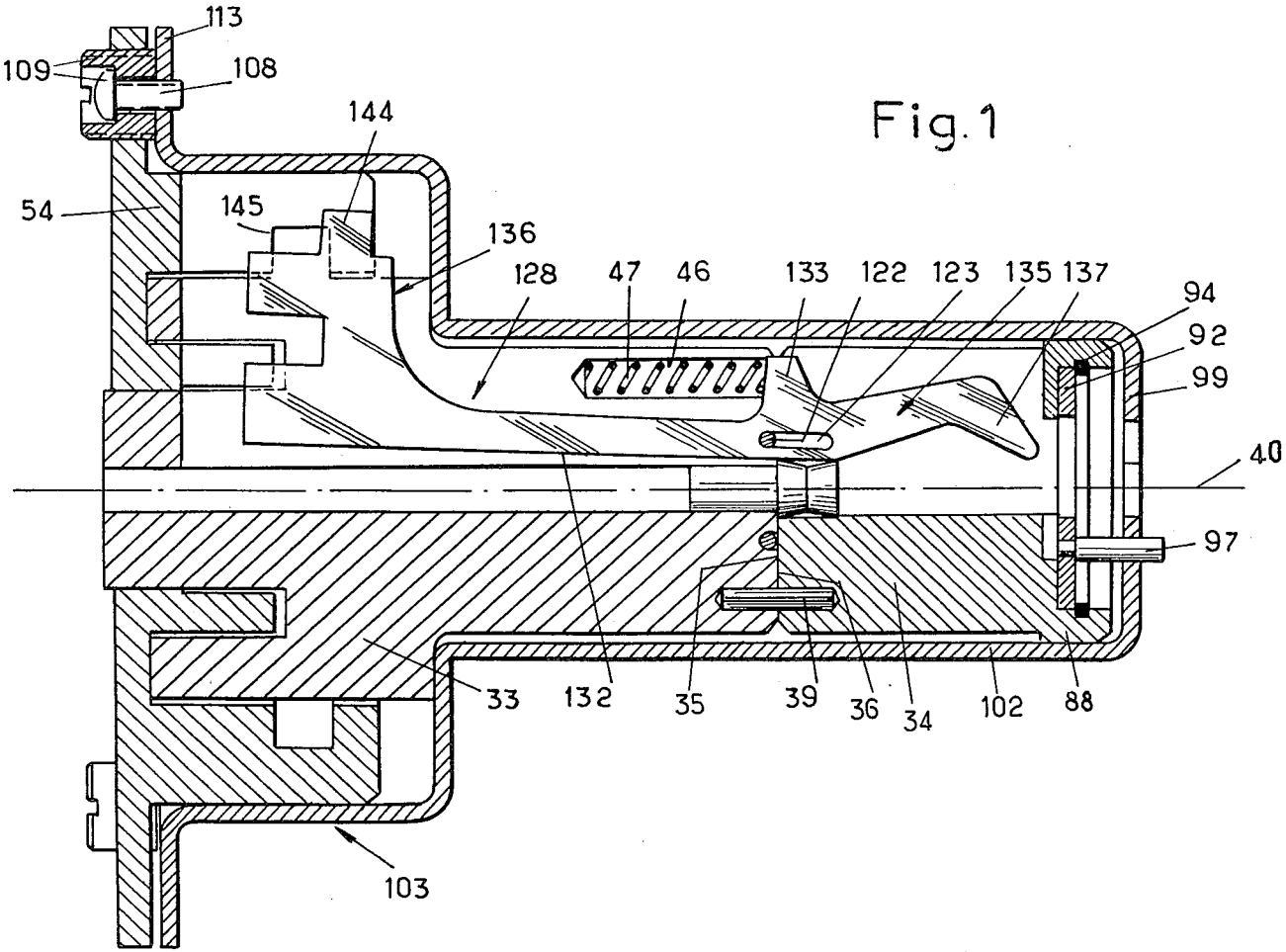
FIG. 1 is a longitudinal cross-sectional view taken on line 1—1 in FIG. 2, for one condition of the lock.
Figure 2:
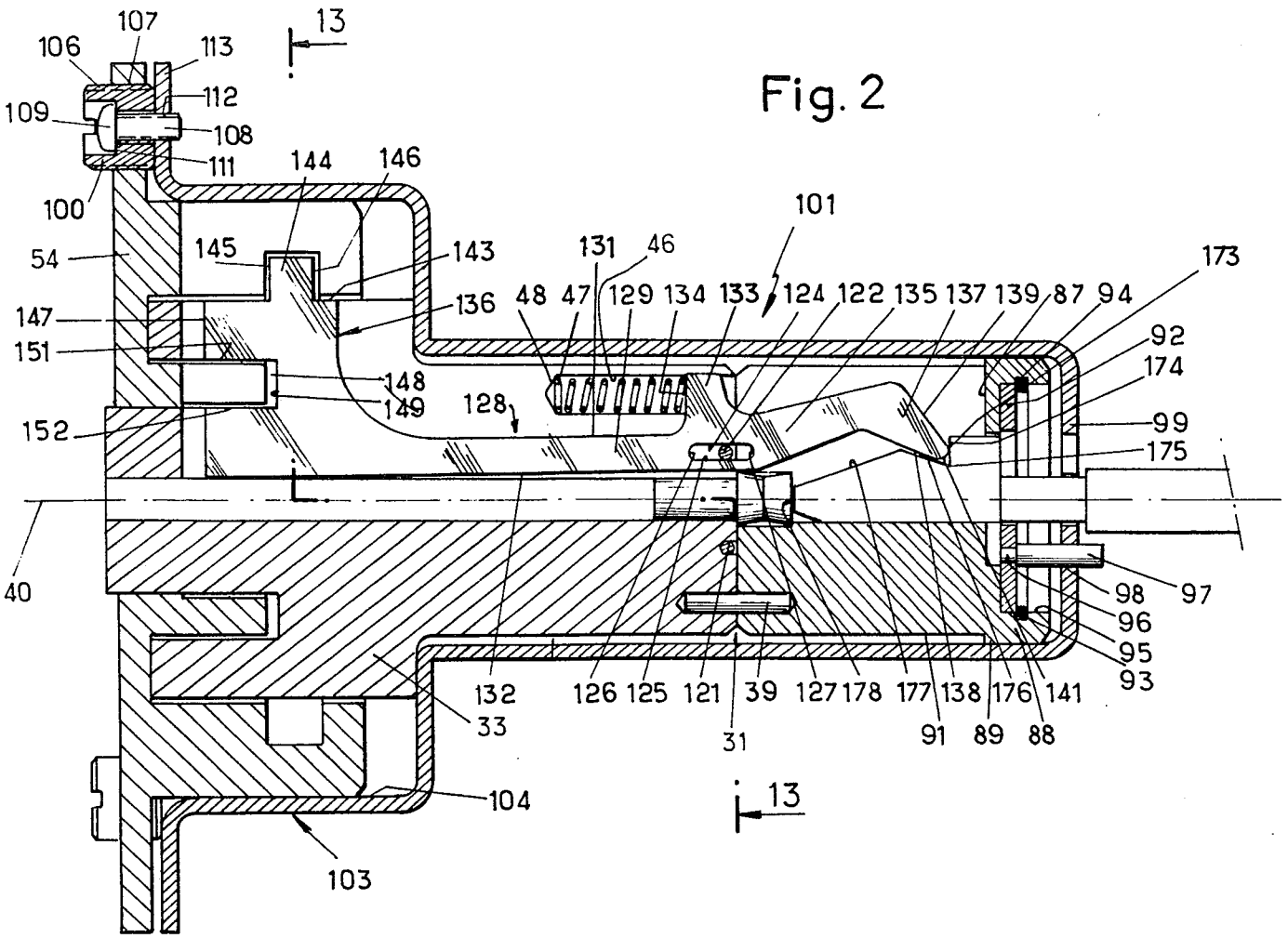
FIG. 2 is a view similar to that of FIG. 1, but for another position.
Figure 5:
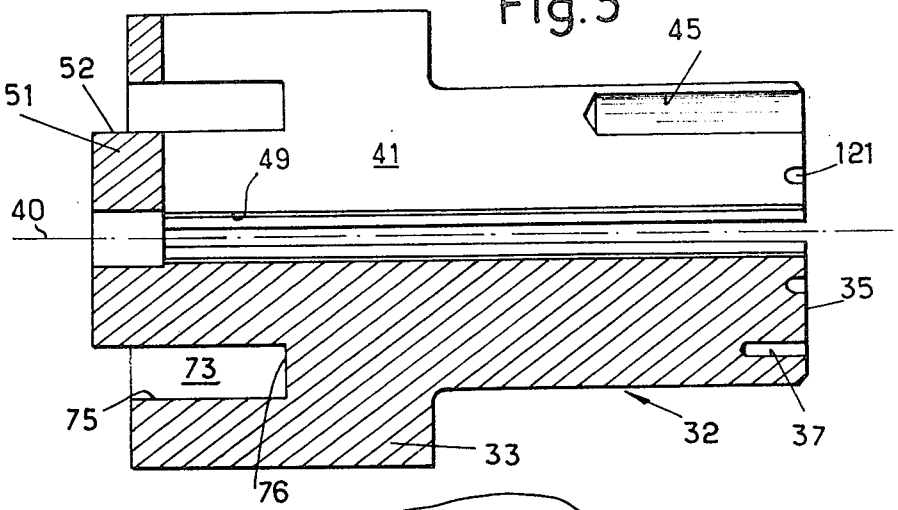
FIG. 5 is a cross-sectional view taken on line 5—5 in FIG. 3.

The barrel 31 is made of a barrel body 32 (FIGS. 1 to 10) of general cylindrical shape flaring out into a barrel base 33, and a barrel nose piece 34. The barrel body 32 and the nose piece 34 are connected by their registering transverse faces 35 and 36 respectively. On face 35 emerge blind drill holes 37 and on face 36 blind drill holes 38. Said drill holes 37 and 38, in alignment, provide accommodation for channeled pins 39 providing connection for the barrel body 32 and the barrel nose piece 34 by forcible insertion of said pins into said drill holes.

Radial cuts 41, which are eight in number in the example shown, are formed in the barrel body 32, with equi-angular distribution about axis 40 of the latter. They are limited by faces 42 and 43 and emerge into a central channel 49 of axis 40.

Semi-cylindrical hollows 44 and 45 formed in faces 42, 43 and emerging on face 35 define in barrel body 32 housings 46 provided for housing coil springs 47 bearing on the bottoms 48 of said housings.

A central posterior bossing 51 of the barrel base 33 has a side cylindrical surface 52 for cooperation with the central drill hole 53 of a locking disc 54 (FIGS. 6 and 7) forming the fixed part of the lock.

The disc 54 is formed with a central crown 55, protruding towards the inside, limited by an outer face 56 and an inner face 57. Radial cuts 58 limits by radial faces 59 and 61, define in said crown teeth 62. The cuts 58 are eight in number, as the cuts 41, and are equi-angularly distributed.

The locking disc 54 is also formed with an outer crown 63 divided by radial cuts 64, said cuts being substantially of the same width as cuts 58 and in line with the latter. They are limited by faces 65 and 66 and form between them blocks 67. In crown 63 is provided a circular path 68 limited by two transverse faces 69 and 71 and a base 72.

For reception of the inner crown 55 of the locking disc 54, the barrel base 33 is formed with a circular path 73 limited by the cylindrical surface 52, an outer cylindrical surface 75 and a base 76.

The barrel nose piece 34 (FIGS. 8 to 10) joined side by side with barrel body 32 is formed with a central channel 81 extending from channel 49, but having in the vicinity of the transverse face 36 an enlarged portion 82 which forms a shoulder 83. As the barrel body 32, the barrel nose piece 34 is formed with radial cuts 84 limited by radial faces 85 and 86 and extending from cuts 41. Said cuts 84 emerge on face 36, but are limited in the region of their front end by a bottom 87.

Figure 12:
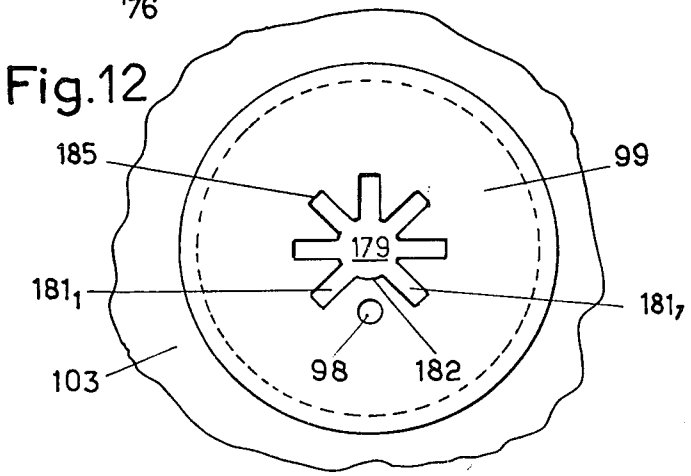
FIG. 12 is a fragmentary view of the lock front face.
Figure 3:
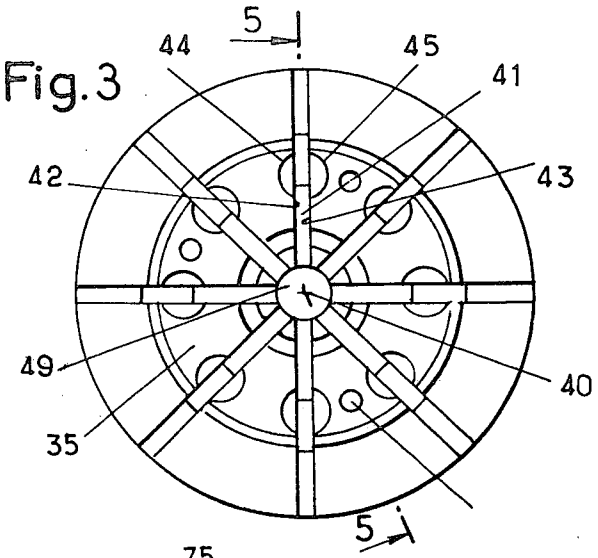
FIG. 3 is a view of the barrel as seen from its foreward front face.
Figure 4:
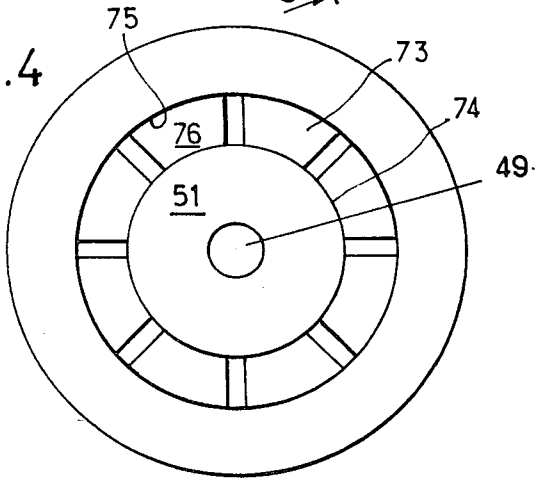
FIG. 4 is a view of the barrel as seen from its rear front face.
Figure 7:
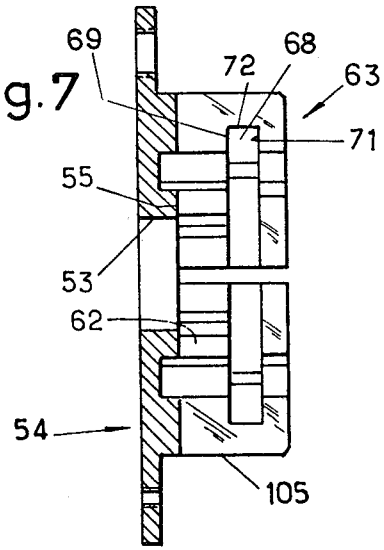
FIG. 7 is a cross-sectional view taken on line 7—7 in FIG. 6.
Figure 8:
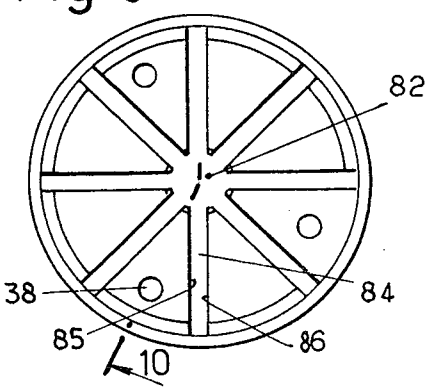
FIG. 8 is a view of the barrel nose piece as seen from its rear front face.
Figure 6:
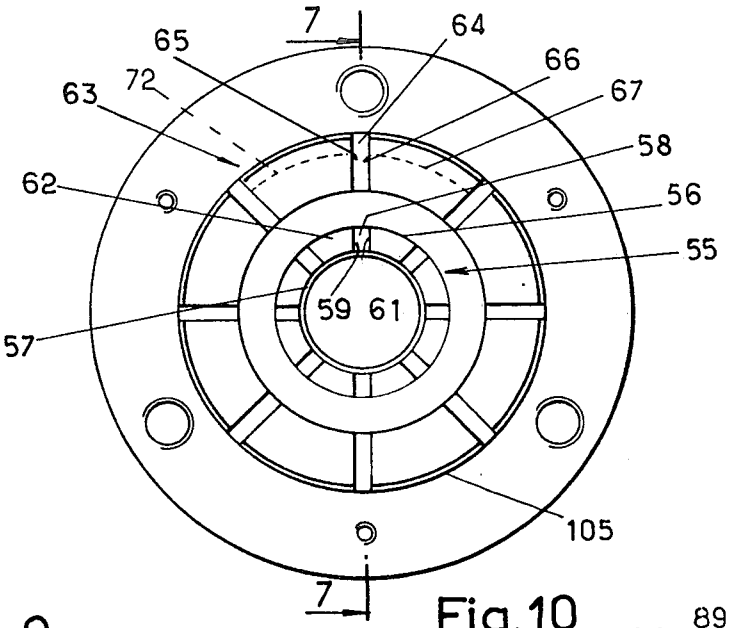
FIG. 6 is a view of the locking disc as seen from its foreward front face.
Figure 10:
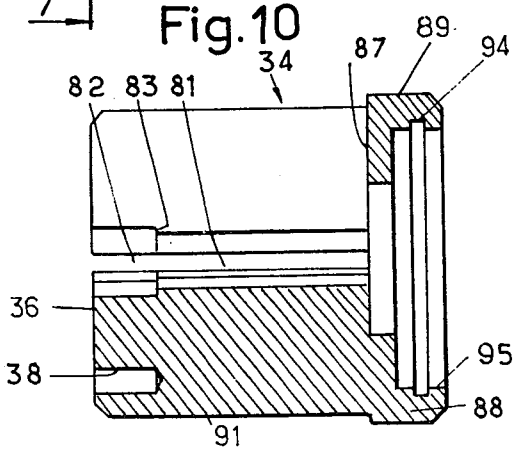
FIG. 10 is a cross-sectional view taken on line 10—10 of FIG. 8.
Figure 9:
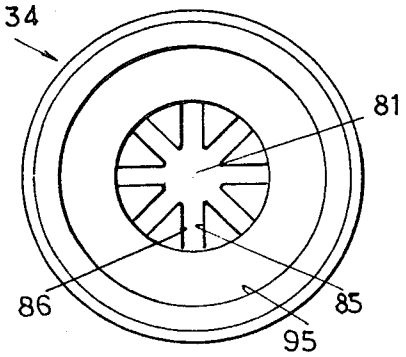
FIG. 9 is a view of the barrel nose piece as seen from its foreward front face.
Figure 11:
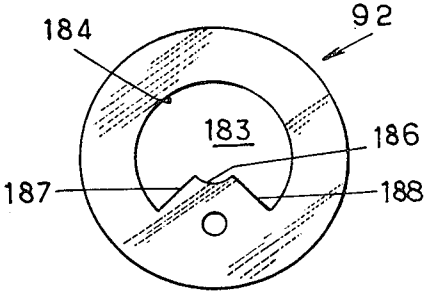
FIG. 11 is a front view of a key stop ring.

The front portion of the barrel nose piece 34 is a flange 88 the outer lateral surface of which 89 is of larger diameter than the lateral surface 91 of the remaining portion of the barrel nose piece. Said flange provides a cup for receiving a key stop ring 92 (FIG. 11) locked in position by a circlips 93 housed in a groove 94 of the inner surface 95 of the cut. Said ring 92 is fiedly attached to a pin 97 through a portion 96 of said pin of smaller diameter which, through engagement in a passage 98 of the front wall 99 (FIG. 12) of a lock case 101 provides locking of said ring.

The lock case 101 has a cylindrical body 102 surrounding the barrel nose piece 34 and the barrel 32; a portion of larger diameter 103 of the lock case is used as housing for the locking disc 54 which it surrounds closely with its inner surface 104 which cooperates with the outer surface 105 of the disc crown 63. The fixing of lock case 101 to the locking disc 54 is provided by nuts 100 with outer threads 106 cooperating with threaded holes 107 of disc 54, a screw 108, with a head 109 engaging the bottom 111 of a hole formed in the nut, cooperates with a tapping 112 of the lock case edge 113. An adjustment is thereby provided allowing taking in account eventual manufacturing irregularities.

In a groove 121 (FIG. 5) of barrel body 32 emerging on the transverse face 35 of the latter is housed a retaining ring 122 the portions of which are comprised in radial cuts 41 are each used for mounting a lever bar 128, via a buttonhole 123 formed on said lever bar, limited by rectilineal edges 124 and 125 connected to semi-circular portions 126 and 127. From body 129 of said bar, limited by two edges 131 and 132 which are substantially parallel, depend an appendix 133 subjected on one of its edges 134 to the action of a spring 47 as well as, on either side of the body, as seen from a longitudinal point of view, on one side a lever bar head 135 and on the opposite side a lever bar tail portion 136.

The lever bar head 135 ends with a beak-shaped portion 137 limited by two converging rectilinear edges 138 and 139 connected by a curved portion 141.

The lever bar tail portion 136, distant from the buttonhole 123 by at least twice the distance between beak 137 and said buttonhole opening, is cut out in such manner as to form on its outer edge 143 most remote from axis 40 a tooth 144 of rectangular configuration, the radial edges of which 145 and 146 are slightly less distant than are faces 69 and 71 of passage 68 of locking disc 54. The outer transverse edge 147 of the lever bar tail portion 136 is cut out in such manner as to be formed with a notch 148 with rectangular contour limited by a bottom 149 and by longitudinal edges 151 and 152 spaced apart from each other by a distance which is slightly superior to the thickness of the inner crown 55 of the locking disc 54.

A key for cooperation with said lock comprises a key hem 161 (FIGS. 14 and 15) which, at the opposite end of the key holding ring 162 has a cylindrical portion 163 with a diameter smaller than hem 161 and thereby connected to the latter via a shoulder portion 164. The operative portion 165 of the key comprises a body 166 of general cylindrical shape adjacent reduced portion 163 and extending in the opposite direction by a portion of general frustoconical shape 167. The operative portion 165 of the key is formed with key bits 168, with the same angular distribution about the key axis 160 as the barrel cuts and the lever bars, but less numerous by one unit than said cuts, said key bits being therefore in the example seven in number. The angle between successive key bits is thereby equal to that which separates two radial cuts of the barrel, except the one which separates key bits 168-7 from key bit 168-1 which is double the angle between the other key bits. Each key bit 168 protrudes relative to core 169 of the operative portion 165 of the key.

A key bit 168 is limited by two parallel side faces 171 and 172. After the key bit cut, the operative outer edge comprises a cylindrical plane portion 173 connected to a transverse shoulder portion 174. From the inner end 175 of the latter starts an ascending ramp 176 from end 175, frustoconical or plane, and which extends through a descending portion 177 to the front abutment face 178.

The front base 99 of lock case 101 is formed with a cutting 179 having a configuration corresponding to that of the key head 165 with key bits 168, the cutting having radial branches 181-1 to 181-7 and a circular edge 182 in correspondance with central channel 81.

Ring 92 provides a window 183 the circular edge of which 184 substantially circumscribes, in projection, the bottoms 185 of branches 181 and is connected to a circular edge 186, of same disposition than edge 182, through radial rectilinear edges 187 and 188.

Figure 17:
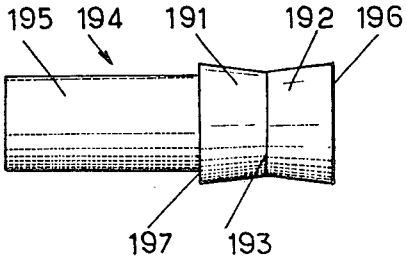
FIG. 17 is a view of a key abutment member.
Figure 13:
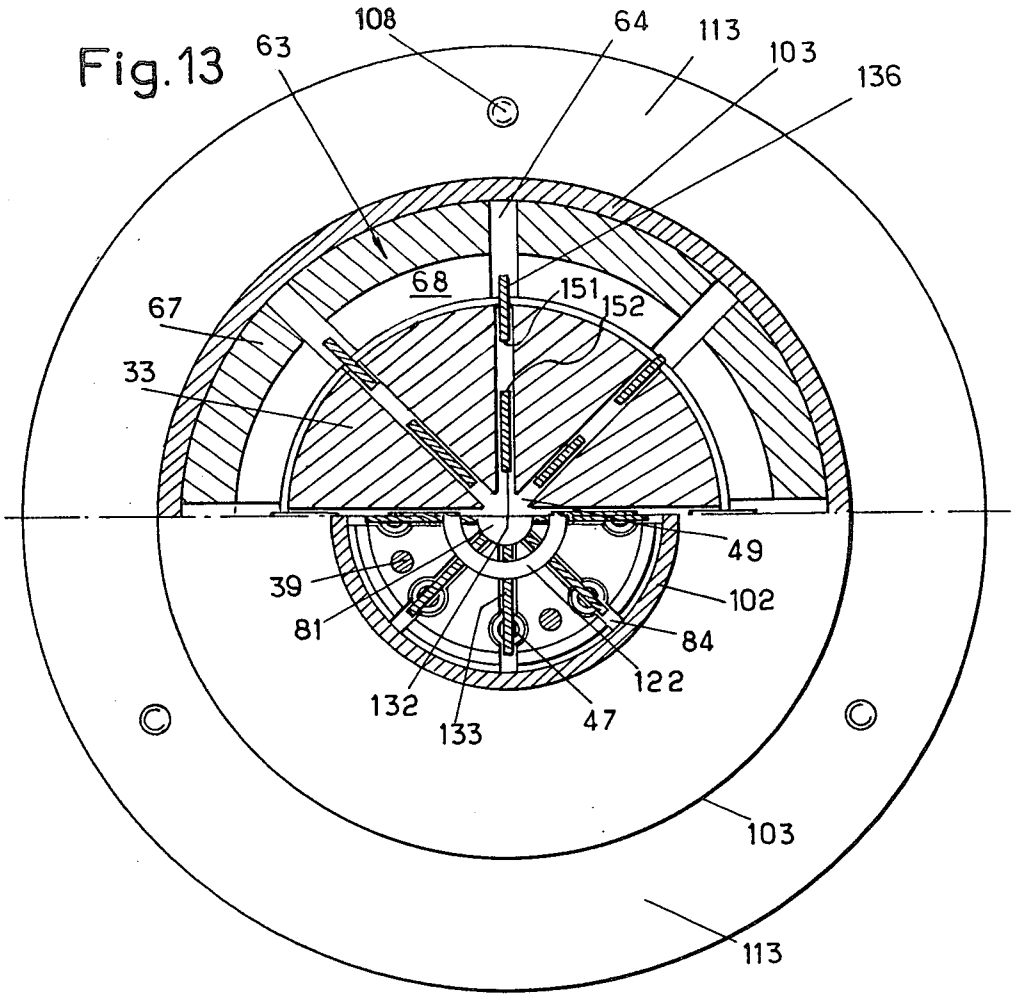
FIG. 13 is a sectional view taken on line 13—13 of FIG. 1.

In the enlarged portion 82 of the axial bore of the barrel nose piece 34 are housed the frustoconical portions 191 and 192 (FIG. 17), adjacent by their smallest section 193 of an abutment piece for key 194 the cylindrical body of which 195 is housed in the channel 49 of the barrel body 32. The blocking of the key abutment piece 194 is provided by engagement of its foreward front edge 196 against shoulder 83 of channel 81 and by engagement of its ring shoulder portion 197 formed at the connection with body 195 against the transverse face 35 of the barrel body.

The operation is the following:

Before introduction of the key in the lock, for instance for opening, the lock is in a condition where the radial slots 41 of the barrel body 32 housing bodies 129 and the lever bar tail portions are in the same angular position as the radial slots 64, of larger width, of the locking disc 54.

The lever bars 128 are, under the action of springs 47, in the position shown in FIG. 1, the movements of the lever bars which are subjected to the action of springs 47 being limited by abutment of bottoms 126 of the buttonhole openings 123 against retaining ring 122.

When the key is introduced, the ascending ramp 177 of each key bit 168 engages the round portion 141 of the beak portion 137 of each of the lever bars. The progression of the key being carried on, each beak 137, after passing over the top portion connecting ramps 177 and 176, follows said ramp 176 under the biasing action of spring 47. Said beak engages the vertical edge 174 and the lever bar progresses then according to a longitudinal movement: this operation of the lever bars is carried out until abutment of the front face 178 of the key against the front surface 196 of part 194. In this position, each lever bar has its longitudinal position determined by the distance between edge 174 of the key bit to which it corresponds and the front face 178, and the rotary position of the lever bar about the axis formed by retaining ring 122 is determined by the distance between the contact point of lever beak 137 with ramp 176 of the key bit relative to the common axis 40 of the key and the barrel.

All the parts of the lever bars are therefore in predetermined positions and in particular tooth 144 and notch 148 of each lever bar tail portion. If the key introduced in the lock is the good key, then the teeth 144 of the lever bars are all in register with passage 68 of the locking piece 54 and the notches 148 are all in register with crown 55 of locking disc 54. This is the condition shown in FIG. 2.

By turning the key once it has reached its maximum inserted position, barrel 31 is rotatably driven by cooperation of the key bits 168 of the key with the opposite faces 85 and 86 of cuts 84 of the barrel nose piece 34. Each of teeth 144 travels in passage 68 of the outer crown 63 of locking disc 54 and faces 151 and 152 of its cutting 148 pass in front of faces 56 and 57 of the inner crown 55 of the locking disc 54. As soon as the barrel 31 has slightly rotated, the action exerted by spring 47 against appendices 133 does not risk to displace the lever bars 128 nor the key in a return movement even if the user does not apply any more a pressure on the key holding ring: the action of springs 47 is actually transferred by beaks 137 of the lever bars against the transverse edges 173 of the key, at least one of the key bits of which engages the full portion of ring 92 adjacent the circular arc 184; and the key thereby cannot move backwards.

The rotation of the barrel actuates in known manner the opening of the bolt, either by pins fixedly attached to the barrel, or by a peripheral toothed section formed on the latter.

When the rotation over one turn is completed, the bolt or bolts are completely retracted and the door may be opened. The key has resumed its initial position and may be easily extracted from the lock.

The closing is performed in the same manner, by turning the key in reverse direction to the opening, as is usual.

The lock is therefore provided with a double safety device, the one which is provided by cooperation of the teeth 144 of the lever bars with a passage 68 of disc 54, and that which is provided by cooperation of the notches 148 with the inner crown 55 of disc 54.

The strength of the lock is not only increased, all things being equal, but difficulties for picking the lock or decoding it are increased.

The number of combinations provided by the lock is higher than that of known Bramah locks: two variations factors are then available instead of one only.

The reproduction of the key is difficult.

Reference is now being made to FIGS. 18 to 23 corresponding to an alternative embodiment. In this embodiment, the barrel 201 (FIG. 20) rotatably mounted about an axis 202, relative to a lock case 203 surrounding it about its cylindrical body 204 and continued by a barrel base 205, is formed with cuts, three in number in the example, 206-1, 206-2 and 206-3, parallel between themselves. Each of said cuts 206 is limited by two longitudinal plane faces 207 and 208 and by a posterior bottom 209. It emerges on the foreward front face 211 of the barrel. The barrel 201 is rotatably mounted via a backward central bossing 212 cooperating with a locking disc 213 fixedly connected to the flange 214 of the cup-shaped portion 215 of lock case 203 by a screw and nut unit 216. A skirt 217 formed on the barrel bottom 205 is engaged between an inner crown 218 of the locking disc and an outer crown 219 of said disc.

Each cut 206 houses two lever bars 221*a*, 221*b* positioned side by side. Each lever bar 221 (FIG. 18) has a body 222 in which is formed a buttonhole opening 223 limited by two parallel rectilinear edges 224 and 225 connected by two rounded edges 226 and 227. From body 222 depends, towards the front, a lever head 228 limited by two sides 229 and 231 and ending by a beak 232 with converging edges 233 and 234 connected by a rounded apex 235. Opposite the posterior portion of the buttonhole opening 223, body 222 of the lever bar is formed with a protruding lug 236 the posterior edge of which 237 is biased by a coil spring 238 housed in a drill hole 239 of the barrel the bottom of which 241 provides support for the spring.

From body 222 extends, at the end opposite to head 228, a tail portion 242 forming two transverse bars 243 and 244 on either side of body 222. Bar 243 is formed at its end with a tooth 245 limited by two transverse sides 246 and 247, connected by a side 248, and, half way through the bar, with a cutting 249 limited by two longitudinal sides 251 and 252 connected by a side 253. Bar 244 opposite to bar 243 is also formed with a tooth 254 and a cutting 255.

The locking disc 213 provides on its outer crown 219 (FIG. 20) a circular passage 256 limited by two transverse ring surfaces 257 and 258 connected by a cylindrical surface 259. The inner crown 218 of the locking disc 213 is limited by an inner cylindrical surface 261 and an outer cylindrical surface 262.

A common axis 264 extends through the buttonhole openings 223 of the lever bars 221, said axis being maintained in transverse bores 265 to 268 of the barrel body 201. A transverse abutment rod 269 is maintained in bores 271 to 274 of the barrel body and capable (FIG. 18) of cooperation with an edge 275 of the lever bars connecting one side 276 of said lever body with side 229. The ends of the abutment rod 269 are also maintained (FIG. 20) in holes 277 and 278 formed in a sleeve 279 interposed between lock case 203 and the barrel, and continuing in a foreward edge 281. A key stop ring 282 is interposed between said edge 281 and the barrel. A pin 283 (FIG. 18) carried by said ring extends through a hole 284 of the front wall 285 of said lock case.

Figures 14, 15, 16, 21, 22, 23:
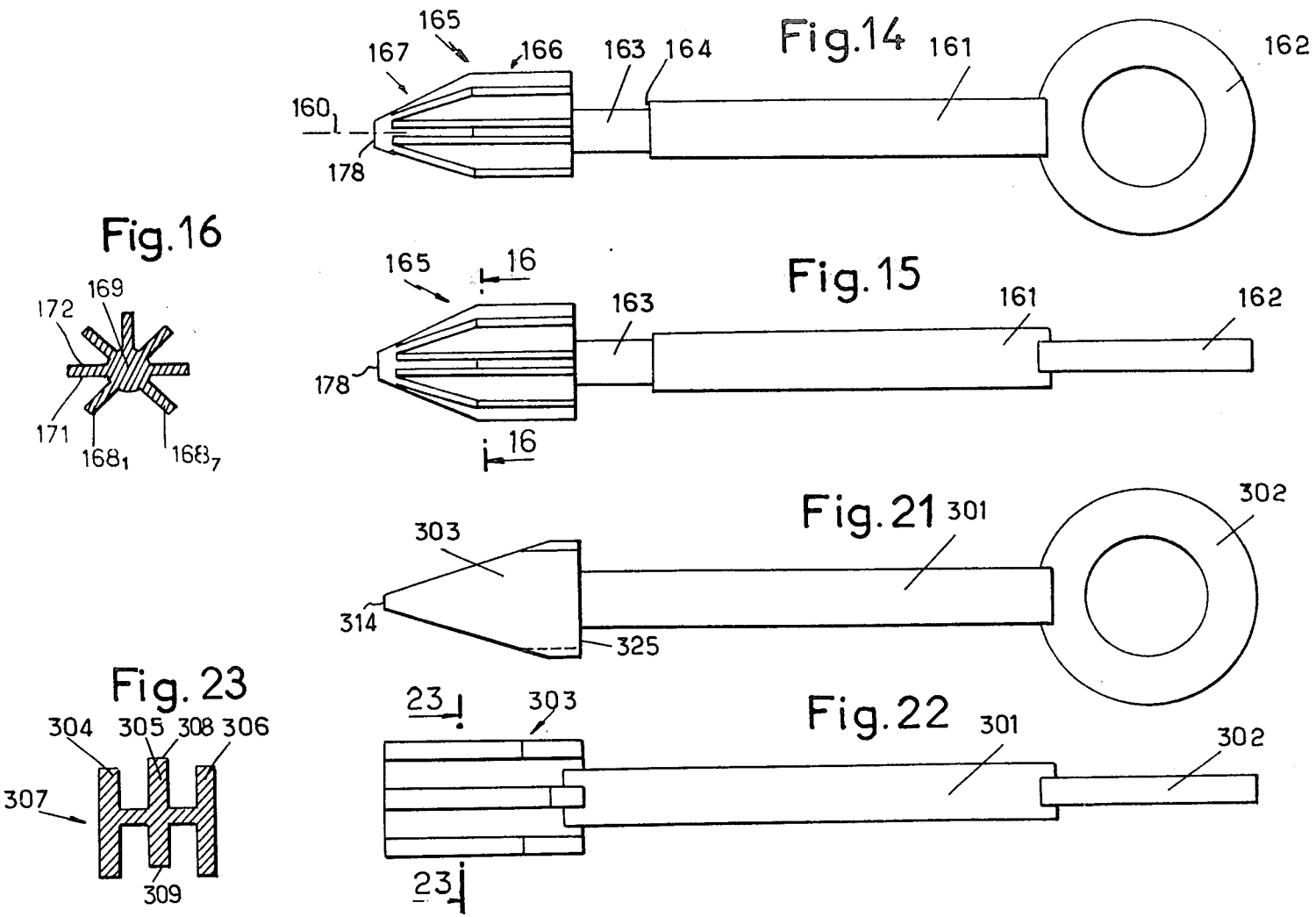
FIG. 14 shows a key before cut out.
FIG. 15 is a view similar to that of FIG. 14, but at an angle of 90° in relation with the latter.
FIG. 16 is a cross-sectional view taken on line 16—16 of FIG. 15.
FIG. 21 is a view of a key provided for cooperation with the lock of FIGS. 18 to 20, before providing the key with its cuts.
FIG. 22 is a plan view corresponding to that of FIG. 21.
FIG. 23 is a cross-sectional view taken on line 23—23 in FIG. 22.

A key capable of cooperation with the lock is shown in FIGS. 21 to 23. It comprises, besides the key hem 301 ending by holding ring 302, a key body 303 having three parallel key bits 304, 305 and 306. Said key bits are formed on a key core 307 and extend on either side of said core. Each key bit is operative by its upper edge 308 and its lower edge 309. Each edge is formed with an oblique ramp 311 followed by a portion 312 parallel to the key axis 313. Edges 309 and 308 of the same key bit are connected by an abutment face 314.

Figure 18:
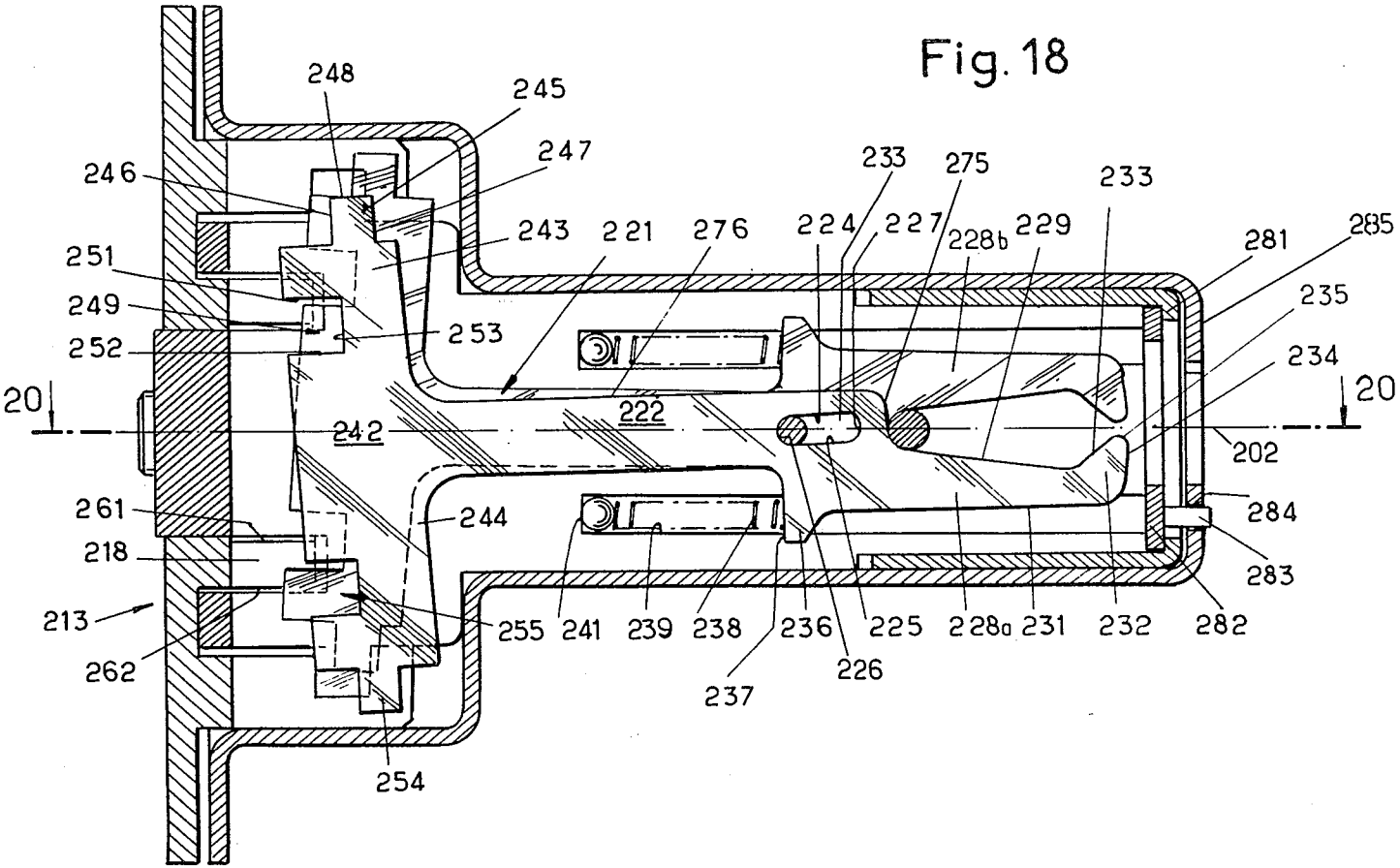
FIG. 18 is a longitudinal cross-sectional view of a modified embodiment of the lock according to the invention.
Figure 19:
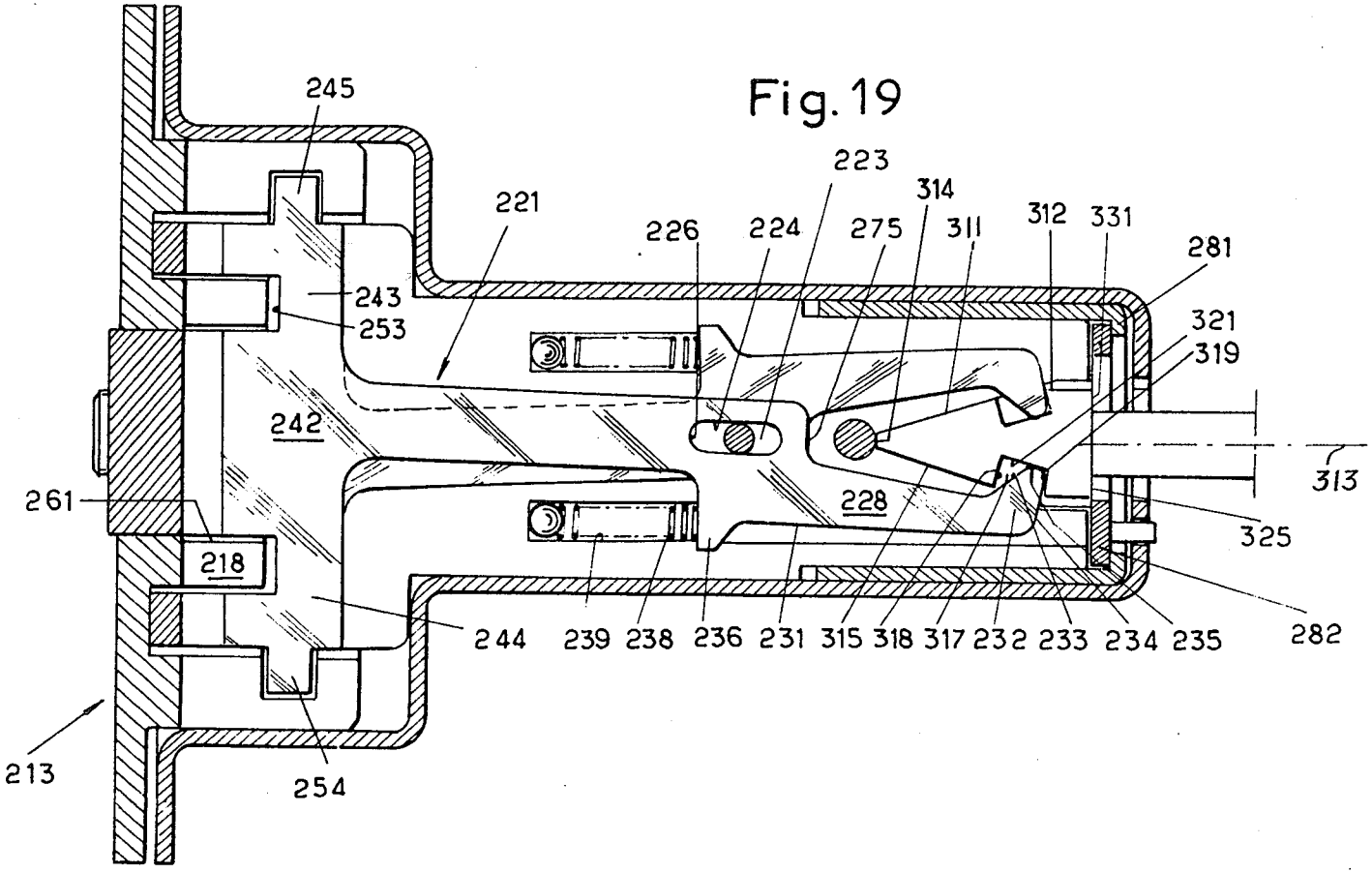
FIG. 19 is a view similar to that of FIG. 18, but for another condition.
Figure 20:
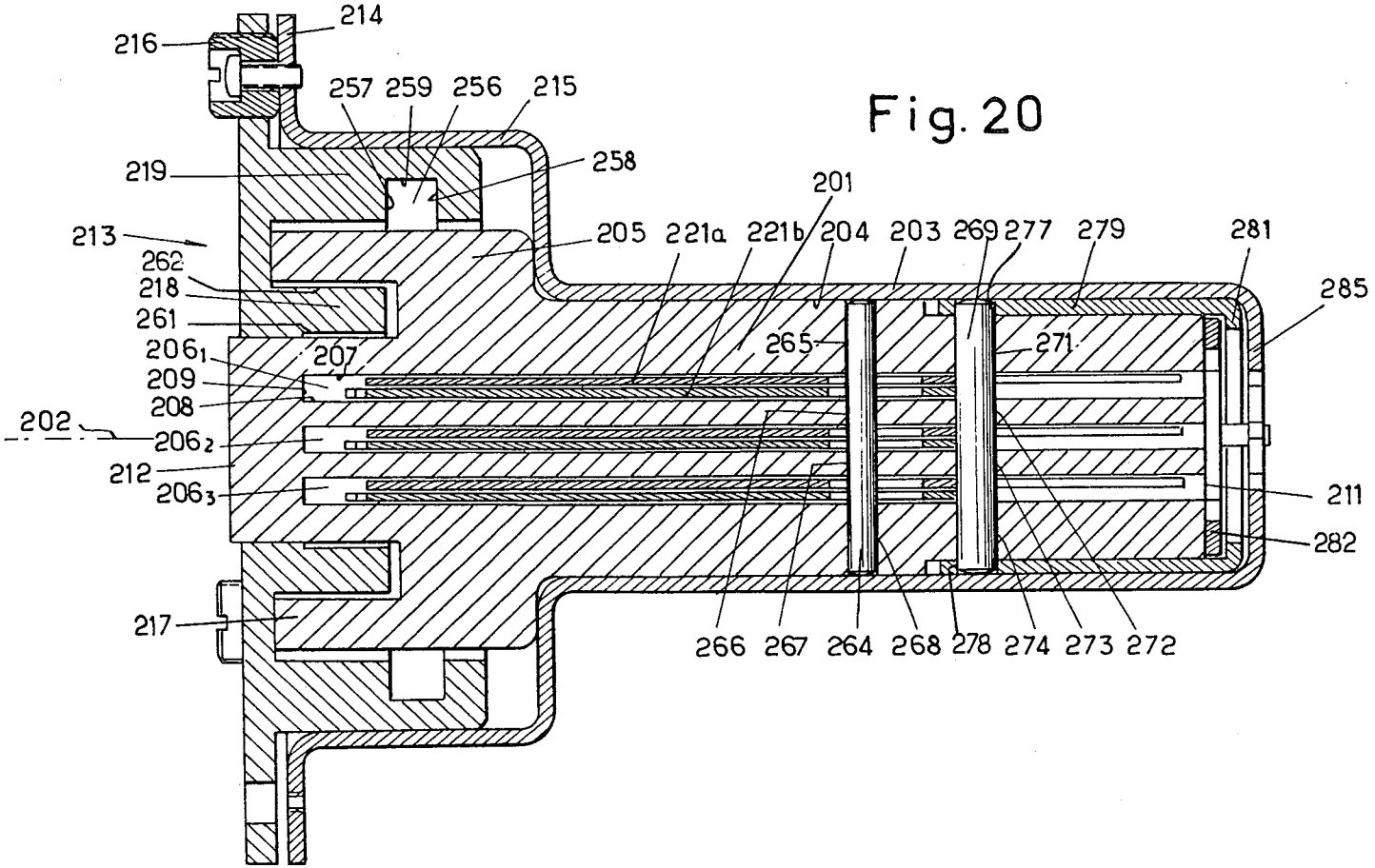
FIG. 20 is a cross-sectional longitudinal view of said lock, but at an angle of 90° relative to that of FIGS. 18 and 19.

In FIG. 18 is shown the position of lever bars 221 before introduction of the key, the position being assumed under the action of springs 238. For this position, the tooth 245 is not in register with passage 256 of the locking disc and the cutting 249 is not in register with the crown 218 of said locking disc.

By introducing the key, the ramp 315 of the lower edge of the key bit engages by its end close to axis 202 the rounded apex 235 of lever bar 221 (FIG. 19) and, by progressing, the key progressively draws away said apex from axis 202, and this against the action of spring 238. When apex 235 comes in register with a cut 317 of the lower edge 309 of said key bit, limited by two sides 318 and 319 perpendicular to ramp 315 and a bottom 321, it falls in said cut under the action of spring 238. The lever bar 221 is pushed back to the rear by cooperation of the side 319 of the cut with edge 234 of the lever bar head 232 and this until complete introduction of the key, defined by abutment of the frontal faces 314 of the key bits against rod 269. For this condition of complete introduction of the key, the position of the lever bar is determined in the longitudinal direction by the position of side 319 of cut 317 relative to a reference, which may be the front face 325 connecting the key head 303 with the key hem 301, and the position of said lever bar rotating about axis 264 is determined by the depth of cut 317, therefore of side 321.

For the good key corresponding to the lock, the cuts 317 are such that by complete introduction of the key, the tooth 245 of each lever is in register with passage 256 of the locking disc and the cut 255 is in register with crown 218 of the locking disc.

In each groove 206 is housed a first lever bar according to the disposition shown in FIG. 18, that is with the head 228*a* underneath axis 202 and joined alongside, a second lever bar with its head 228*b* above axis 202, in such manner that its beak 232 may cooperate with a cutout of the upper edge 308 of the same key bit. As soon as, after introduction of the key, said key has been imparted with a slight rotation movement, the cooperation of the rearward edge 325 of a key bit against an inside protruding portion of the key stop ring 282 impedes by abutment the rearward movement of the key under the action of springs 238.

By turning the key, barrel 201 carrying the levers 221 rotates, driving the bolt or bolts, the teeth 245 of the lever bars circulating in passage 256 and the cuts 255 and 249 surrounding the cylindrical surfaces 261 and 262 forming the inner crown 218.

After rotation over a complete turn, the key is removed and the lever bars resume their initial position under the action of their respective springs.

The closing of the lock is performed in the same manner, through rotation of the key in reverse direction to that of the opening.

What I claim is:

1. A Bramah lock comprising movable longitudinal members carried by a barrel and one end of which is adapted to cooperate with a key in such manner that its other end which has at least two cuttings operative for locking that the locking device which cooperates with said members does not prevent rotation of the barrel when said members are actuated by the key, wherein each longitudinal member is mounted such as being longitudinally movable relative to the key introduction axis and also rotatably about a transverse axis, with locking corresponding to each of said movements.

2. A lock according to claim 1, wherein each longitudinal member is mounted via an axle cooperating with a longitudinal buttonhole opening in said member in such manner as to be movable longitudinally and also in rotation about its axis.

3. A lock according to claim 1, wherein each longitudinal member is mounted via an axle cooperating with a longitudinal buttonhole opening in the lever bar in such manner as to be movable longitudinally and also in rotation about its axis.

4. A lock according to claim 3, wherein the longitudinal members are housed in radial cuts of the barrel.

5. A lock according to claim 3, wherein the longitudinal members are housed in parallel cuts of the barrel.

6. A lock according to claim 1, wherein the barrel comprises cuts in each of which are housed two longitudinal members.

7. A lock according to claim 1, wherein the key has at least one key bit and a ring provides stoppage of the key relative to a rearward movement as soon as said key has been turned from its introduction position through the cooperation of the key bit with a radial projection of said ring.

8. A longitudinal member for use in a Bramah lock according to claim 1, to engage a key and provide for locking having a body with a head and tail portion, said head portion being beak-shaped, said tail portion having a tooth and notch which provides two cuttings operative for locking, said body having a button-hole opening to receive a retaining ring, and an appendix to receive a spring load thereon wherein when incorporated in the lock the member is longitudinally movable therein when a key engages the member while also being rotatably movable about a transverse axis.

9. A key for use in a Bramah lock according to claim 1 having a key head, a cylindrical body adjacent to said head, the head having a core, front face and rear shoulder with at least one key bit between said front face and rear shoulder protruding relative from the core, said key bit having an operative outer edge which engages the longitudinal member of the lock during insertion of the key in the lock whereby said member is moved axially and rotatably about a transverse axis due to said surface and abutement of the member with the rear shoulder to a locked or unlocked position depending upon the angularity of the operative outer edge and position of the rear shoulder.

10. A Bramah lock comprising a housing provded with a key opening, a barrel mounted rotative about an axis in said housing and provided with at least one tumbler lodging slot, at least one tumbler, each tumbler having a rearward portion and a forward beak located near the key opening in order for the tumblers to be positioned by a key, said tumbler being rotatable in said slot in such a way that said forward beak of said tumbler can be moved with respect to the axis by the key and being movable along the direction of said axis in such a way that each forward beak can be moved away from the keyhole by said key, each rearward portion being formed with at least two edges, a first edge being operable for locking the barrel against rotation by cooperation with a housing member when a predetermined rotation of each tumbler is not effected by the key and a second edge being operable for locking the barrel against rotation by cooperation with another housing member when a predetermined translation of each tumbler is not effected by the key.

11. A Bramah lock according to claim 10, wherein each tumbler is provided with an abutement portion for an elastic mean lodged in said barrel, each tumbler being capable of rotation about a transverse axis located close to said abutement portion, and said elastic mean being such that its thrust is directed approximately along the direction of said axis.

12. A Bramah lock according to claim 11, wherein said elastic mean is located away from said axis.

13. A Bramah lock according to claim 10, wherein one of the edge forms a locking tooth and the other a locking notch.

14. A Bramah lock according to claim 10, wherein each tumbler is mounted on a transversal axle engaging a longitudinal opening of the tumbler.

* * * * *

UNITED STATES PATENT AND TRADEMARK OFFICE

CERTIFICATE OF CORRECTION

PATENT NO. : 4,196,606

DATED : April 8, 1980

INVENTOR(S) : Francois Guiraud

It is certified that error appears in the above—identified patent and that said Letters Patent is hereby corrected as shown below:

Column 2, line 34, change "limits" to --limited--;
line 63, change "circlips" to --clip--;
line 64, change "fiedly" to --fixedly--;

Column 5, line 21, insert --but-- before "by";

Column 7, line 31, after "locking" (1st occurrance), insert --is urged in a position such--;

Column 8, lines 21, 46 and 49, change "abutement" to --abutment--.

Signed and Sealed this

Tenth Day of March 1981

[SEAL]

Attest:

RENE D. TEGTMEYER

Attesting Officer

Acting Commissioner of Patents and Trademarks